US009004966B2

(12) United States Patent
Mayer

(10) Patent No.: US 9,004,966 B2
(45) Date of Patent: Apr. 14, 2015

(54) SWIM FIN ATTACHMENT

(71) Applicant: Brian Mayer, Santa Cruz, CA (US)

(72) Inventor: Brian Mayer, Santa Cruz, CA (US)

(73) Assignee: Brian Mayer, Santa Cruz, CA (US)

( * ) Notice: Subject to any disclaimer, the term of this patent is extended or adjusted under 35 U.S.C. 154(b) by 186 days.

(21) Appl. No.: 13/632,301

(22) Filed: Oct. 1, 2012

(65) Prior Publication Data

US 2013/0090028 A1 Apr. 11, 2013

Related U.S. Application Data

(60) Provisional application No. 61/543,372, filed on Oct. 5, 2011.

(51) Int. Cl.
*A63B 31/08* (2006.01)
*A63B 31/11* (2006.01)

(52) U.S. Cl.
CPC ..... *A63B 31/11* (2013.01); *A63B 2209/10* (2013.01)

(58) Field of Classification Search
USPC ..... 441/64
IPC ..... A63B 31/11
See application file for complete search history.

(56) References Cited

U.S. PATENT DOCUMENTS

| | | | | |
|---|---|---|---|---|
| 895,451 | A | | 8/1908 | Gorham |
| 1,494,452 | A | | 5/1924 | Waldron |
| 1,571,462 | A | | 2/1926 | Waldron |
| 2,073,570 | A | | 6/1936 | Sutherland |
| D151,229 | S | | 10/1948 | Eddy |
| 2,672,629 | A | | 4/1949 | La Trell |
| 2,779,077 | A | | 2/1952 | Kline |
| 2,729,832 | A | | 1/1956 | Schmitz |
| 3,107,372 | A | | 10/1963 | Brown et al. |
| D203,364 | S | | 12/1965 | Brunner |
| 3,344,449 | A | | 10/1967 | Grilli |
| 3,649,979 | A | | 3/1972 | MacNiel |
| 3,810,269 | A | | 5/1974 | Tabata |
| 4,007,506 | A | | 2/1977 | Rasmussen |
| 4,264,994 | A | | 5/1981 | Carbone |
| 4,294,022 | A | | 10/1981 | Stockli |
| 4,738,645 | A | | 4/1988 | Garofalo |
| 4,752,259 | A | | 6/1988 | Tackett |
| 4,832,644 | A | | 5/1989 | Roberts |
| 4,887,985 | A | | 12/1989 | Garofalo |
| 5,041,039 | A | | 8/1991 | Chang |
| 5,242,321 | A | | 9/1993 | Gil |
| 5,266,062 | A | | 11/1993 | Runckel |
| 5,290,194 | A | | 3/1994 | Sneddon |
| 5,324,219 | A | * | 6/1994 | Beltrani et al. ..... 441/64 |
| D349,552 | S | | 8/1994 | Fleming |
| 5,595,518 | A | | 1/1997 | Ours |

(Continued)

*Primary Examiner* — Stephen Avila
(74) *Attorney, Agent, or Firm* — Pullman & Comley, LLC

(57) ABSTRACT

The present invention is generally directed to a swim fin generally including a fin blade and a bootie, the bootie including a foot pocket configured to receive a user's foot and ankle, the foot pocket attached to the top surface of the fin blade; and a strap system including one or more straps pulling the user's foot and ankle into the foot pocket toward the distal edge of the fin blade and down against a top surface of the fin blade. Some aspects of the present invention may also include a foot pocket formed from a first portion having a first elastic characteristic connected to the top surface of the fin blade; and a second portion having a second elastic characteristic portion disposed at least on a portion of the top surface of the foot pocket, the second elastic characteristic being greater than the first elastic characteristic.

15 Claims, 5 Drawing Sheets

(56) References Cited

U.S. PATENT DOCUMENTS

| | | | | | |
|---|---|---|---|---|---|
| 5,766,050 | A | | 6/1998 | Maggi | |
| 5,795,204 | A | | 8/1998 | Bruner | |
| 5,810,629 | A | | 9/1998 | Parr | |
| 5,813,889 | A | | 9/1998 | Perry | |
| 5,820,428 | A | * | 10/1998 | Stadler | 441/64 |
| 5,899,781 | A | | 5/1999 | McLaughlin | |
| 5,924,902 | A | | 7/1999 | Burns | |
| 6,182,377 | B1 | | 2/2001 | Toensing | |
| 6,224,443 | B1 | | 5/2001 | Mehrmann et al. | |
| 6,341,383 | B1 | | 1/2002 | Beltrani | |
| 6,401,256 | B1 | | 6/2002 | Shreve | |
| 6,435,926 | B1 | | 8/2002 | Yeh | |
| 7,140,938 | B1 | * | 11/2006 | Ware | 441/64 |
| 2001/0016461 | A1 | | 8/2001 | Kawashima | |
| 2003/0027469 | A1 | | 2/2003 | Testa | |
| 2003/0036321 | A1 | | 2/2003 | Green | |
| 2004/0209534 | A1 | | 10/2004 | Graham | |
| 2005/0221698 | A1 | * | 10/2005 | Sclafani | 441/64 |

* cited by examiner

SWIM FIN ATTACHMENT

RELATED APPLICATIONS

This application claims priority to U.S. Provisional Patent Application 61/543,372 filed on Oct. 5, 2011.

BACKGROUND OF THE INVENTION

The present invention is generally directed to fins often used in activities such as lap swimming, scuba diving, snorkeling, and surfing ("swim fins"). More particularly, the present invention is directed to the physical interface that connects a user to a swim fin blade.

Some fins attach to a user's foot utilizing pockets that are configured to receive a portion or all of a user's foot, much like a shoe. Such pockets may be constructed of either rigid or soft and flexible materials. Often, such pockets are configured to receive only a portion of a user's foot, and have an open heel or back area. In such situations, a user's foot is often held in place—inserted into the pocket—through the use of one or more straps.

However, each of these means has certain drawbacks and disadvantages. For example, in certain situations rigid foot pockets chafe the user's feet, resulting in discomfort and potential injury. This drawback is significant since swim fins are often used in scuba diving, snorkeling, and surfing—environments where abrasive materials, such as sand, is prevalent. This drawback is also significant in repetitive activities, such as lap swimming.

Pockets in swim fins made from soft and flexible materials also suffer from drawbacks and disadvantages. Soft pockets are generally more comfortable for the user, but such swim fins typically allow for unwanted motion of the user's foot relative to the swim fin blade. Unwanted motion may limit the force the user may effectively apply to the swim fin blade and may limit the size, shape, and stiffness of the swim fin blade, thus resulting in limited performance.

Additionally, regardless of whether the foot pocket is formed from a soft or rigid material, existing swim fins generally lack a secure attachment sufficient to prevent the swim fin from being forcibly removed from the user's foot when external forces are applied. Yet, in use swim fins are often exposed to external forces caused from waves, surf, currents, kelp, etc.

The prevalence of swim fins being forcibly removed is evident from the original manufacture and after-market accessory of a tether. In general, swim fin tethers comprise a mechanical attachment (for example, a strap or other connection) between the swim fin and the user. For example, a strap may connect to a swim fin and then be secured to a user's ankle. The addition or purchase of a tether increases the cost of such swim equipment and may provide other drawbacks, such as discomfort and excessive drag when used.

Further, although swim fin attachments are generally available in varying sizes, they generally lack the ability to conform to variations in foot size and shape, resulting in a poor fit.

Moreover, swim fin attachments as generally available typically present gaps and spaces between the user and the swim fin. Such gaps may cause increased hydrodynamic drag to the swimmer due to fluid flowing along the interface between the user and the swim fin. This increased drag may result in reduced performance.

Accordingly, it is desirable to provide an interface between a user and a swim fin that is comfortable—even in environments where abrasive materials are present, provides an improved fit to various foot shapes and sizes, does not allow unwanted motion, cannot be forcibly removed by external forces, and does not increase hydrodynamic drag on the swimmer. Such an interface is additionally desirable because it may allow increased fin size, various fin shapes, and/or various degrees of fin stiffness or rigidity, which may therefore result in increased swim fin performance.

SUMMARY OF THE INVENTION

Some aspects of the present invention may include a swim fin bootie, comprising a foot pocket and a strap system.

Some aspects of the present invention may include a swim fin bootie comprising a fin blade having a distal edge and a top surface; a foot pocket configured to receive a user's foot and encircling at least a portion of the user's ankle, the foot pocket attached to the top surface of the fin blade; and a strap system comprising one or more straps, the one or more straps pulling the user's foot and ankle into the foot pocket toward the distal edge of the fin blade and down against the top surface of the fin blade.

Some aspects of the present invention may include a swim fin bootie, comprising: a fin blade having a distal edge and a top surface; a foot pocket configured for receiving a user's foot and ankle, comprising: a first portion having a first elastic characteristic, the first portion connected to the top surface of the fin blade; a second portion having a second elastic characteristic, the second elastic characteristic being greater than the first elastic characteristic, the second portion disposed at least on a portion of the top surface of the foot pocket; a strap system, comprising: one or more straps comprised of a substantially non-stretching material; and a tightening mechanism to tighten the one or more straps around the foot pocket.

These and other aspects will become apparent from the following description of the invention taken in conjunction with the following drawings, although variations and modifications may be effected without departing from the spirit and scope of the novel concepts of the invention.

BRIEF DESCRIPTION OF THE DRAWINGS

The present invention can be more fully understood by reading the following detailed description together with the accompanying drawings, in which like reference indicators are used to designate like elements. The accompanying figures depict certain illustrative embodiments and may aid in understanding the following detailed description. Before any embodiment of the invention is explained in detail, it is to be understood that the invention is not limited in its application to the details of construction and the arrangements of components set forth in the following description or illustrated in the drawings. The embodiments depicted are to be understood as exemplary and in no way limiting of the overall scope of the invention. Also, it is to be understood that the phraseology and terminology used herein is for the purpose of description and should not be regarded as limiting. The detailed description will make reference to the following figures, in which.

DETAILED DESCRIPTION OF THE INVENTION

The matters exemplified in this description are provided to assist in a comprehensive understanding of various exemplary embodiments disclosed with reference to the accompanying figures. Accordingly, those of ordinary skill in the art will recognize that various changes and modifications of the exemplary embodiments described herein can be made without departing from the spirit and scope of the claimed invention. Descriptions of well-known functions and constructions are omitted for clarity and conciseness. Moreover, as used herein, the singular may be interpreted in the plural, and alternately, any term in the plural may be interpreted to be in the singular.

In general, the present invention is directed to fins often used in activities such as lap swimming, scuba diving, snorkeling, bodyboarding, and surfing ("swim fins"). More particularly, the present invention is directed to the physical interface, or bootie, that connects a user's foot and/or ankle to a swim fin blade.

Figure 1A:
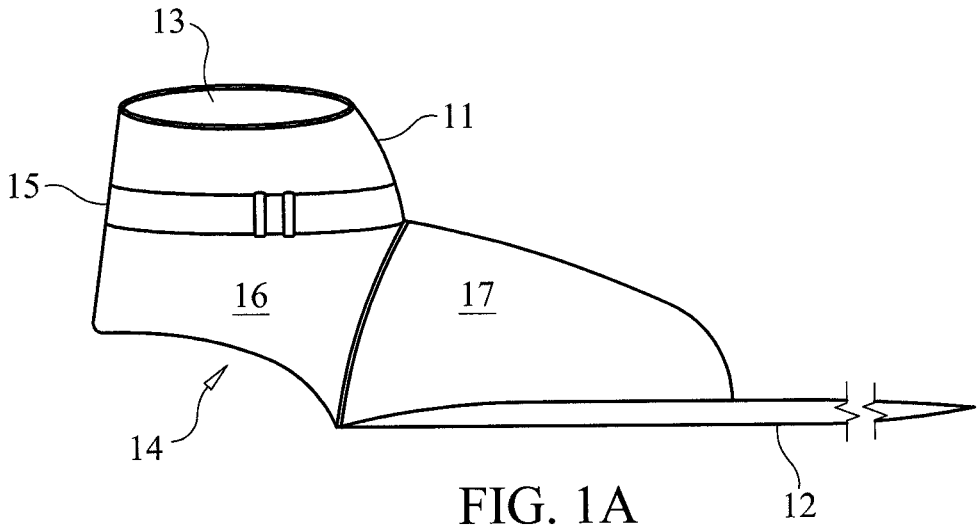
FIG. 1A is a side view of a swim fin bootie and fin blade in accordance with some embodiments of present invention.
Figure 1B:
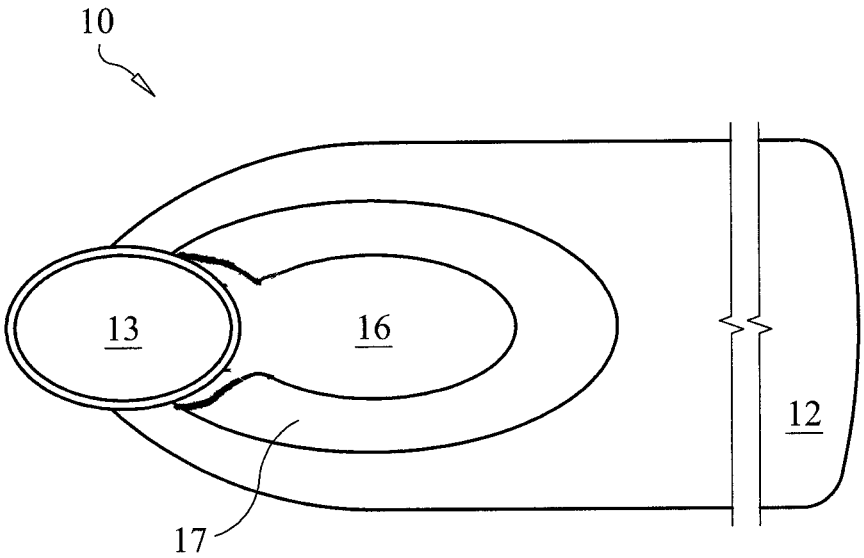
FIG. 1B is a top view of a swim fin bootie and fin blade in accordance with some embodiments of present invention.

With reference to FIGS. 1A and 1B, a swim fin 10 in accordance with some embodiments of the present invention will be discussed. Swim fin 10 may generally comprise a bootie 11 and a swim fin blade 12. It is contemplated that the swim fin blade 12 may be of any particular shape or size suitable for use as a swim fin, and may have varying characteristics of flexibility, materials, etc. The bootie 11 may be formed generally as a pocket into which a user's foot may be inserted. The bootie 11 may comprise an ankle opening 13 for the user's ankle (which may also be used when putting on and removing the bootie). The bootie 11 may optionally comprise a heel opening for the user's heel 14. Alternatively, the heel may be closed.

While the bootie 11 may be comprised of a single material type, it is contemplated that in some embodiments of the present invention the bootie 11 may comprise at least two (2) different materials. With continued reference to FIG. 1, the bootie 11 may comprise a stretchable portion 16 of the bootie, and a non-stretchable portion 17. The stretchable portion 16 may be formed from a material that may stretch to provide user comfort and fit, such as but not limited to neoprene. The stretchable portion 16 may be configured to surround the user's ankle in order to accept movement of the user's ankle within the bootie 11. The non-stretchable portion 17 may generally form the pocket—either alone or in conjunction with a portion of the swim fin blade 12—that may accept the front of the user's foot (i.e., toes, top of foot, etc.).

The non-stretchable portion 17 may be formed from a material with limited stretch characteristics, such as but not limited to Cordura™ fabric. The non-stretchable portion 17 may have some stretch characteristic, but may provide for substantially less stretch than the material comprising the stretchable portion 16. The non-stretchable portion 17 may provide for increased support of the swim fin blade 12 by the bootie 11.

Figure 2:
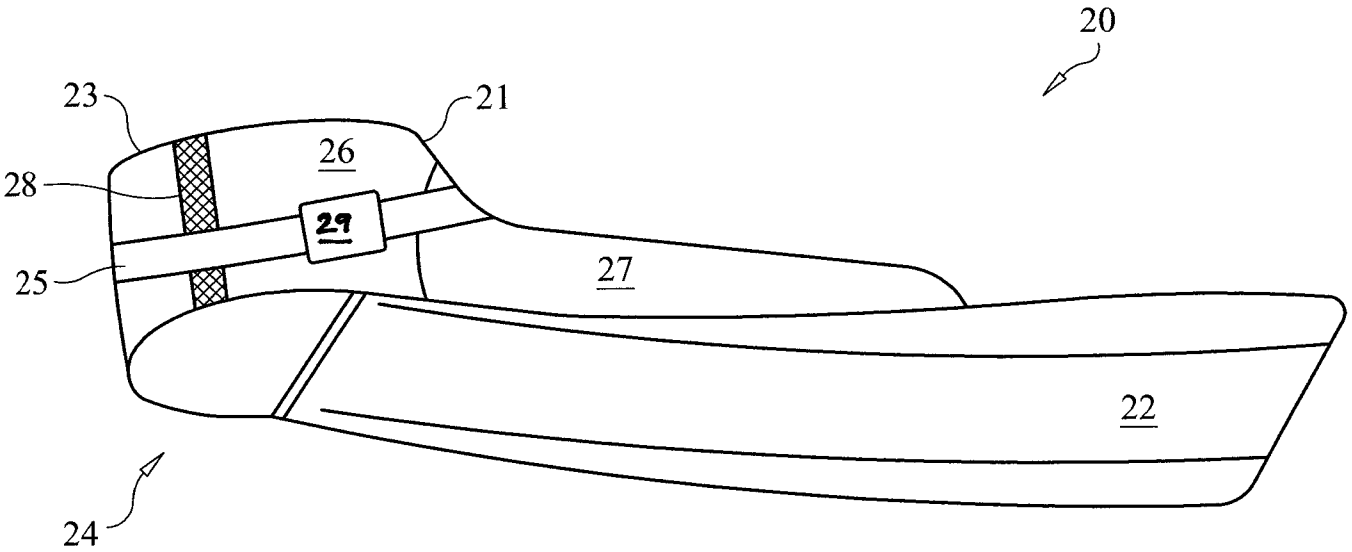
FIG. 2 is a perspective view of a swim fin bootie and fin blade in accordance with some embodiments of present invention.

The stretchable portion 16 and non-stretchable portion 17 may be configured in various embodiments to afford a user with a balance of comfort and blade stability. For example, in accordance with some embodiments of the present invention and as depicted in FIG. 2, the top of the foot pocket may be comprised of the stretchable portion 16 while the non-stretchable portion 17 may provide support near the connection of the bootie 11 to the swim fin blade 12. The top of the bootie 11 may include a stretchable portion 16 so as to allow expansion of the foot pocket to accommodate a variety of foot shapes and facilitate donning the swim fin 10.

In addition, the stretchable portion 16 and the non-stretchable portion 17 need not be exclusive in any section of the bootie 11. For example, the stretchable portion 16 may be layered with the non-stretchable portion 17 so that the user's foot or ankle is in contact with the more comfortable stretchable portion 16 while strength and stability may be provided through the use of the non-stretchable portion 17. Layering the portions in various configurations may also effectively limit the maximum allowed stretch on the stretchable portion 16. Accordingly, it is contemplated that the booty 11 may be comprised of one or more layers of various materials, each with different or similar characteristics and qualities. By layering such materials both comfort and stability may be achieved.

With renewed reference to FIG. 1, the bootie 11 may optionally further comprise a mechanism to tighten the bootie on the user's foot or ankle. For example, in accordance with some embodiments of the present invention and as depicted in FIG. 1, the bootie may further comprise a strap and buckle 15 that may be tightened around a user's ankle. It is contemplated that the mechanism used to tighten the bootie onto the user's foot or ankle may come in any number of forms known in the art, including but not limited to straps and buckles, Velcro, laces, multiple straps, bungee type cords, and/or any other mechanism that can tighten the bootie 11 on or around the user's foot or ankle.

In accordance with some embodiments of the present invention, the strap 15 may be formed of a substantially non-stretching or non-elastic material, such as nylon. The substantially non-stretching nature of the strap 15 may allow the strap 15 to be tightened by the user to the most comfortable extent, and may not stretch or loosen during use. While the strap 15 may be connected or attached to the bootie or fin blade at various ends, the portion of the strap encircling the stretchable portion 16 may be substantially independent of the bootie. As a non-limiting example, the strap 15 may slide independently over the stretchable portion 16, and may be guided relative to the stretchable portion 16 by elements such as loops or other alignment devices.

FIG. 2 illustrates a perspective view of a swim fin 20 in accordance with some embodiments of the present invention. Swim fin 20 may comprise a bootie 21 and a swim fin blade 22. Bootie 21 may comprise an ankle opening 23, a heel opening 24, and a mechanism 25 to secure the bootie 21 to a user. Bootie 21 may comprise a stretching portion 26 that may encircle the ankle and a non-stretching portion 27 may cover the top of the foot and toes and provide attachment of the bootie 21 to the swim fin blade 22. In various other embodiments, the stretching portion 26 and the non-stretching portion 27 may be layered over each other in various manners to provide a desired balance of comfort and strength or support to the user.

In accordance with some embodiments of the present invention, bootie 21 may further comprise a closeable opening 28 in the back or side of the bootie 21. The closeable opening 28 may make the act of donning the swim fin bootie 21 easier and more convenient for the user. Once the user's foot is properly inserted into the bootie 21, the closeable opening 28 may be closed, utilizing a closing mechanism as known in the art (including, but not limited to, Velcro, zippers, buckles, snaps, buttons, laces, and/or other mechanical closures). Utilizing such a closeable opening 28 may also enable a tighter fit in both the foot pocket and the ankle opening 23 of the bootie 21. Furthermore, any straps encircling the ankle may also incorporate a means of attachment and/or detachment 29 such as a buckle, snap, and/or other mechanical means of attachment. Again, as discussed above, the strap may comprise one or more materials that present a tight, substantially non-stretching fit, while allowing for comfort to the user.

Figure 3A:
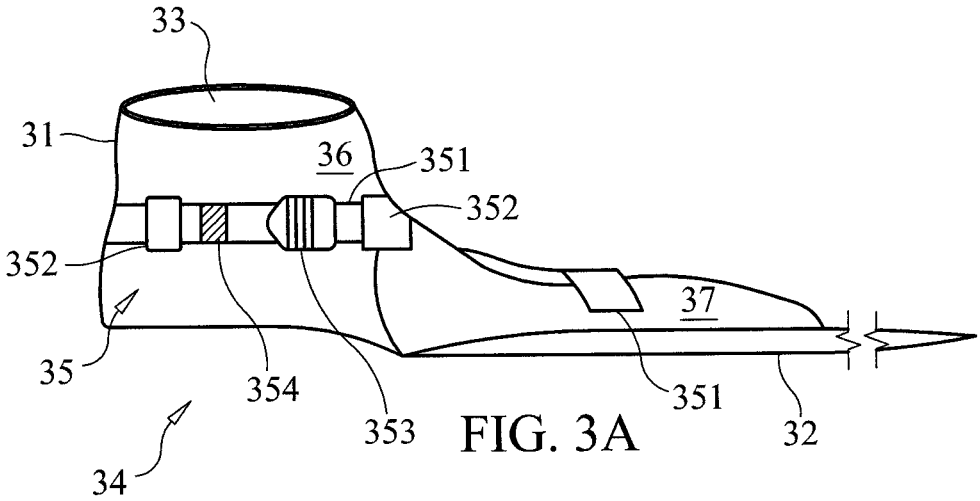
FIG. 3A is a side view of a swim fin bootie and fin blade in accordance with some embodiments of present invention.
Figure 3B:
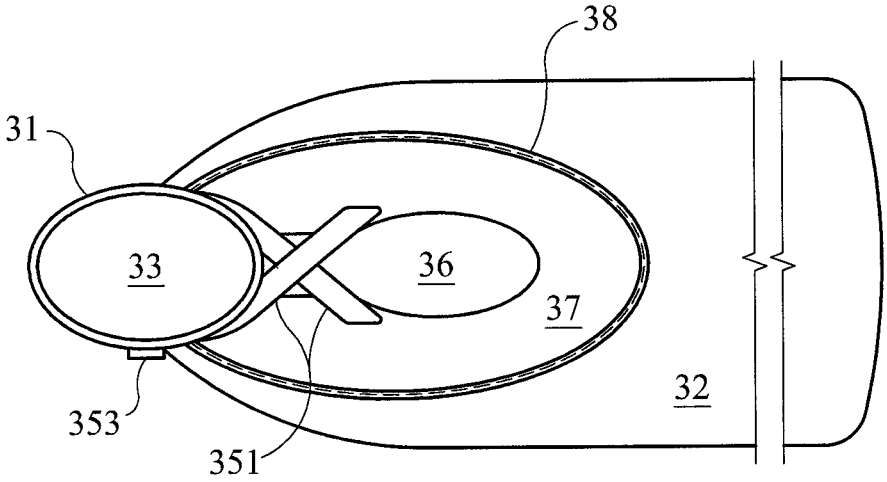
FIG. 3B is a top view of a swim fin bootie and fin blade in accordance with some embodiments of the present invention.

With reference to FIGS. 3A and 3B, additional embodiments of the present invention will now be discussed. Note that while the invention is discussed in numerous embodiments, such exemplary embodiments are not exclusive. Accordingly, it is contemplated that features and attributes from some exemplary embodiments may be utilized in conjunction with features and attributes from other exemplary embodiments. FIGS. 3A and 3B depicts a swim fin 30 generally comprised of a bootie 31 and a swim fin blade 32. The bootie 31 may again comprise an ankle opening 33 and may optionally comprise a heel opening 34. The bootie 31 may be comprised of both a stretchable portion 36 and a non-stretchable portion 37, which may be configured in various manners. In accordance with the exemplary embodiment illustrated in FIG. 3, the swim fin 30 may further comprise a strap system 35 that may be used to tighten the bootie 31 onto the user's foot or ankle and may provide support to the swim fin blade 32 and also prevent the swim fin 30 from being easily and unintentionally removed.

Strap system 35 may comprise one or more straps 351 that may be connected to various portions on the bootie 31, loops 352 to guide the placement of the straps 351, and a cinch 353 (which may also be a buckle or any sort of tightening or holding device (e.g., Velcro, a cam operated holder, etc.). Strap system 35 may also comprise a device 354 to hold the loose end of the straps 351 when tightened to prevent unwanted movement. Such device 354 is contemplated to comprise a Velcro connection, but may be any device which can suitably hold the loose end of the straps.

As shown in FIGS. 3A and 3B, straps 351 may encircle the user's ankle and surround the top of the user's foot and attach to the non-stretchable portion 37 or fin blade 32. This particular configuration, while exemplary, may be advantageous in that it keeps the user's foot firmly pushed into the bootie 31 through the force exerted by the strap around the ankle, while also keeping the user's foot firmly connected to the swim fin blade 32 through the force exerted by the straps crossing over the top of the user's foot. The strap system 35 may allow the swim fin 30 to be sufficiently tightened to the user's foot and/or ankle to reduce motion of the foot relative to the swim fin blade 32 due to the stretching material while swimming.

Again, however, this strap arrangement is exemplary and it is contemplated that various other strap arrangements or designs may be utilized without departing from the scope or spirit of the present invention.

Note that FIG. 3B also depicts stitching 38 where the bootie 31 connects to the swim fin blade 32. The stitching 38 illustrated provides attachment through the swim bootie 31—such as through the non-stretching portion 37, and through the swim fin blade 32 to provide a secure attachment. Note that the stitching 38 is exemplary, and the bootie 31 may be attached to the swim fin blade 32 through any other means generally known in the art, such as but not limited to, through the use of adhesives, other mechanical attachment (rivets, screws, slides, etc.), or through manufacturing processes wherein portions of the bootie may be embedded into the swim fin blade, or the swim fin blade may be formed around portions of the bootie.

Figure 4:
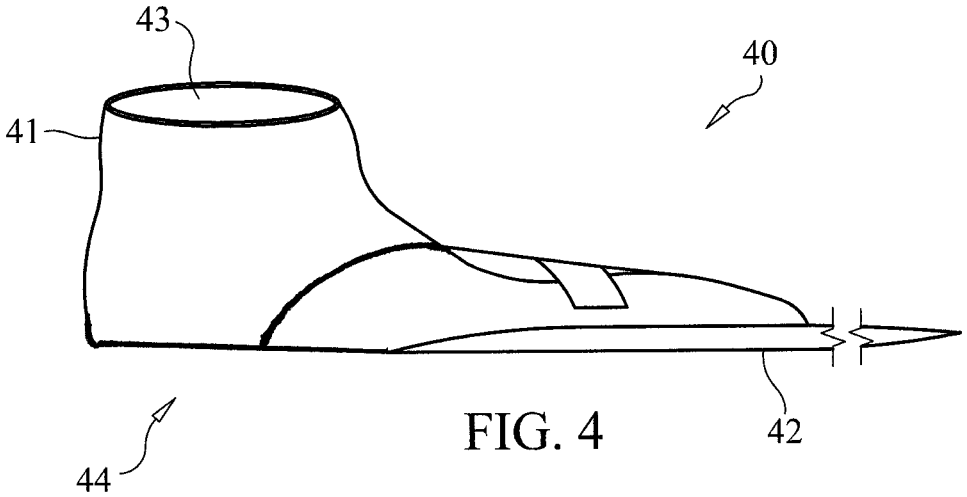
FIG. 4 is a side view of a swim fin bootie with a closed heel and fin blade in accordance with some embodiments of the present invention.

With reference to FIG. 4, a closed heel swim fin 40 in accordance with some embodiments of the present invention will now be discussed. Swim fin 40 may generally comprise a bootie 41 and a swim fin blade 42. The bootie 41 may comprise an ankle opening 43, and may be made from a single material, or from a stretchable and non-stretchable material, such as those discussed above with regard to FIGS. 1-3B. Moreover, swim fin 40 may comprise a bootie 41 that includes a closed heel 44 rather than an open heel. Swim fin 40 may also comprise securing mechanisms (such as but not limited to straps, Velcro, buckles, etc.) in order to firmly attach the swim fin 40 to the user's foot and/or ankle.

Figure 5:
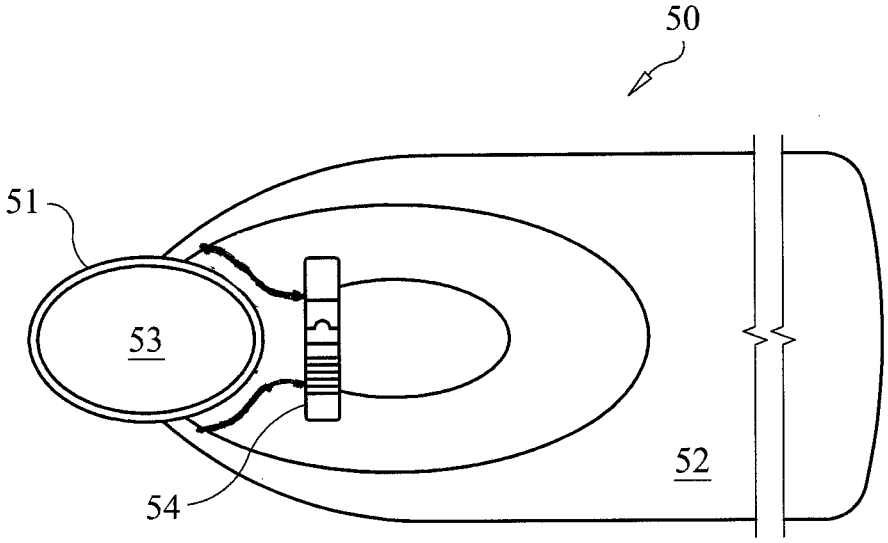
FIG. 5 is a top view of a swim fin bootie and fin blade in accordance with some embodiments of the present invention.
Figure 6:
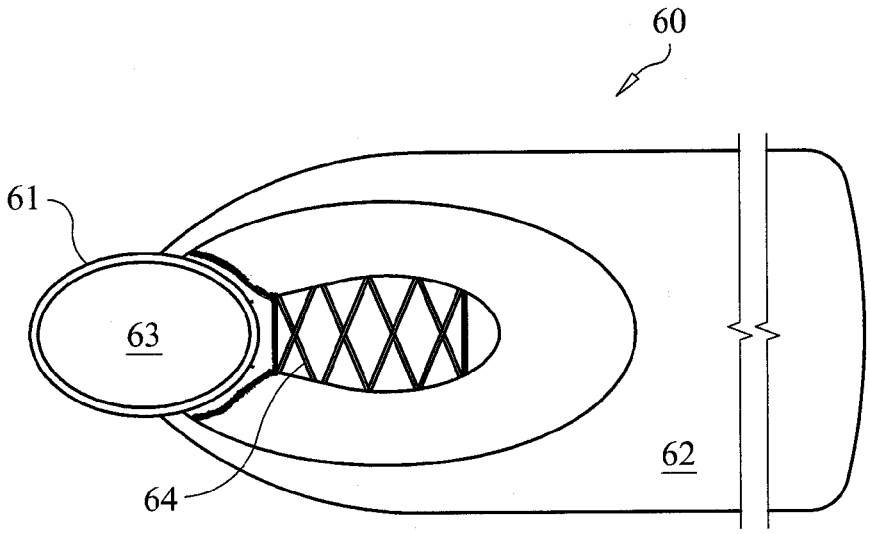
FIG. 6 is a top view of a swim fin bootie and fin blade in accordance with some embodiments of the present invention.

With reference to FIGS. 5 and 6, the swim fin may be secured to the user using different types of securing devices. In accordance with some embodiments of the present invention, and as depicted in FIG. 5, a swim fin 50 may again generally comprise a bootie 51 and a swim fin blade 52. The bootie 51 may generally comprise an ankle opening 53 and may be made from one or more materials of similar or different properties. The bootie 51 may also include a strap 54 positioned across the top of the user's foot, substantially perpendicular to the direction of the user's foot. Strap 54 may comprise a single strap or a plurality of straps and may be tightened to the user's foot using buckles, cams, straps, etc. For example, the bootie 51 may be secured to the user's foot through the use of a buckle similar to that employed in downhill ski boots or in-line skates.

With reference to the swim fin 60 in FIG. 6, laces 64 may be used to secure a bootie 61 and swim fin blade 62 to a user's foot or ankle.

Figure 7:
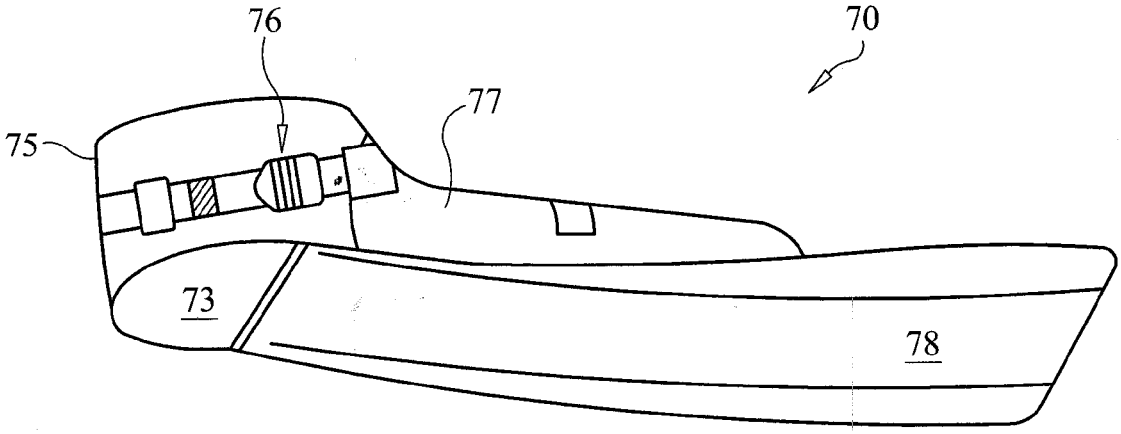
FIG. 7 is perspective view of a swim fin bootie in accordance with some embodiments of the present invention.

FIG. 7 illustrates a bootie 70 in accordance with such embodiments. Bootie 70 may comprise an open or closed heel, may be comprised of one or more types of materials, and may utilize any number of securing mechanisms as discussed throughout. The bootie 70 shown in accordance with some embodiments of the present invention includes an open heel 73, and is comprised of a stretchable portion 76 and a non-stretchable portion 77, a bottom surface 78, and may also comprise a mechanism 75 for securely attaching the bootie 70 to the user's foot and/or ankle. The bottom surface 78 of the bootie 70 may be comprised of a soft, stretchable material in order to increase comfort for the user.

It will be understood that the specific embodiments of the present invention shown and described herein are exemplary only. Numerous variations, changes, substitutions and equivalents will now occur to those skilled in the art without departing from the spirit and scope of the invention. For instance, the straps securing the swim fin bootie to the user may be arranged in any manner; the bootie may be comprised of more than two materials with varying properties; and the swim fin bootie may include additional openings as may be desired. Accordingly, it is intended that all subject matter described herein and shown in the accompanying drawings be regarded as illustrative only, and not in a limiting sense.

What is claimed is:

1. A swim fin, comprising:

a fin blade with a distal edge;

a bootie integrally attached to the fin blade, comprising:

a foot pocket comprising a front portion and a back portion, wherein the front portion is attached to the fin blade, and the back portion comprises a closable opening; and a strap system, comprising:

one or more straps, the strap system having a first end and a second end, and wherein the first end connects to the bootie forward of the user's ankle off of a latitudinal centerline of the bootie, the strap system wraps around the user's ankle and crosses itself on top of the user's foot, and the second end connects to the bootie on an opposite side off of the latitudinal centerline of the bootie than the first end; and a connection mechanism for connecting the one or more straps together, comprising a hook portion and an eye portion, wherein the hook portion is connected to a first strap and wherein the eye portion is connected to a second strap.

2. The swim fin of claim 1, wherein the one or more straps are disposed outside of the bootie and wherein the one or more straps wrap around the user's ankle, such that at least part of the back portion of the bootie is disposed between the strap and at least a portion of the user's ankle.

3. The swim fin of claim 2, wherein the foot pocket further comprises:

a first portion; and a second portion.

4. The swim fin of claim 3, wherein:

the first portion comprises one or more materials, the first portion having a first elastic characteristic;

the second portion comprises one or more materials, the second portion having a second elastic characteristic; and the second elastic characteristic is greater than the first elastic characteristic.

5. The swim fin of claim 4, wherein:

the second portion is disposed on the bootie such that it covers at least a portion of a top of a user's foot when the user's foot and ankle is inserted into the bootie.

6. The swim fin of claim 1, wherein the connection mechanism may further comprise buckles, bungee cords, cinches, hooks, snaps, or laces.

7. The swim fin of claim 1, wherein the strap system comprises a tightening mechanism, configured to tighten the one or more straps around the foot pocket.

8. The swim fin of claim 7, wherein the strap system pulls the user's foot into the foot pocket toward the distal edge of the fin blade and downward toward a top surface of the fin blade.

9. The swim fin of claim 1, wherein the fin blade comprises a distal edge, and wherein the strap system pulls a user's foot into the bootie toward the distal edge of the fin blade and down against the bottom surface of the fin blade.

10. The swim fin of claim 1, wherein the one or more straps are comprised of:

of a substantially non-stretching material.

11. A swim fin, comprising:

a fin blade having a distal edge and a top surface;

a bootie fixed-to the fin blade, comprising:

a foot pocket configured for receiving a user's foot and at least a portion of a user's ankle, comprising:

a first portion having a first elastic characteristic, the first portion connected to the top surface of the fin blade;

a second portion having a second elastic characteristic, the second elastic characteristic being greater than the first elastic characteristic, the second portion disposed at least on a portion of the top surface of the foot pocket;

an element that encircles at least a portion of a user's ankle, the element comprising a closable opening;

a strap system, comprising:

one or more straps comprised of a substantially non-stretching material, the strap system having a first end and a second end, and wherein the first end connects to the bootie forward of the user's ankle off of a latitudinal centerline of the bootie, the strap wraps around the user's ankle and crosses itself on top of the user's foot, and the second end connects to the bootie on an opposite side off of the latitudinal centerline of the bootie than the first end;

a tightening mechanism, configured to tighten the one or more straps around the foot pocket; and a connection mechanism to connect the one or more straps.

12. The swim fin of claim 11, wherein the tightening mechanism may be selected from the group consisting of a buckle, Velcro, laces, bungee cords, cinches, hooks, and snaps.

13. A swim fin comprising:

a fin blade having a distal edge and a top surface;

a bootie fixed to the fin blade, comprising:

a foot pocket configured to receive a user's foot and ankle, the foot pocket attached to the top surface of the fin blade;

an element that encircles at least a portion of a user's ankle, comprising a closeable opening; and a strap system comprising:

a first strap having a first end and a second end, and wherein the first end of the first strap connects to the bootie forward of the user's ankle off of the a latitudinal centerline of the bootie, and the first strap wraps around the user's ankle and crosses on top of the user's foot;

a second strap having a first end and a second end, wherein the first end of the second strap connects to the bootie on an opposite side off of the latitudinal centerline of the bootie than the first end of the first strap and crosses on top of the user's foot;

a connection mechanism for connecting the second end of the first strap to the second end of the second strap;

a tightening mechanism to tighten the strap system; and wherein when connected the strap system pulls the user's foot into the foot pocket toward the distal edge of the fin blade and toward the top surface of the fin blade.

14. The swim fin of 13, wherein the element that encircles at least a portion of the user's ankle comprises one or more portions that are connected around the user's ankle once the user's ankle is inserted into the foot pocket.

15. The swim fin of claim 13, wherein the foot pocket is comprised of a substantially non-stretching material and a substantially stretching material, the substantially non-stretching material being disposed over a forefoot of a user when a user's foot and is inserted into the foot pocket.

* * * * *